US007542714B2

(12) United States Patent
Kim et al.

(10) Patent No.: US 7,542,714 B2
(45) Date of Patent: Jun. 2, 2009

(54) USED TONER COLLECTING DEVICE AND AN IMAGE FORMING APPARATUS HAVING THE SAME

(75) Inventors: Yong-sung Kim, Yongin-si (KR); Jeong-hun Pang, Yongin-si (KR); Hae-seog Jo, Yongin-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 436 days.

(21) Appl. No.: 11/434,134

(22) Filed: May 16, 2006

(65) Prior Publication Data

US 2007/0147918 A1 Jun. 28, 2007

(30) Foreign Application Priority Data

Dec. 22, 2005 (KR) ..... 10-2005-0128133

(51) Int. Cl.
*G03G 21/00* (2006.01)
*G03G 21/12* (2006.01)

(52) U.S. Cl. ..... 399/358; 399/360

(58) Field of Classification Search ..... 399/35, 399/120, 358, 360
See application file for complete search history.

(56) References Cited

U.S. PATENT DOCUMENTS 4,101,215 A * 7/1978 Fottner et al. ..... 399/358
5,848,342 A * 12/1998 Tanda ..... 399/358
5,956,556 A * 9/1999 Nakajima et al. ..... 399/359
2007/0081839 A1* 4/2007 Min et al. ..... 399/358

FOREIGN PATENT DOCUMENTS

| | | | |
|---|---|---|---|
| JP | 03235982 A | * | 10/1991 |
| JP | 9138535 | | 5/1997 |
| JP | 09138579 A | * | 5/1997 |
| JP | 11-327401 | | 11/1999 |
| JP | 2000-330440 | | 11/2000 |
| JP | 2001-265188 | | 9/2001 |
| KR | 1999-005447 | | 7/1999 |
| KR | 10-2005-0003872 | | 1/2005 |

* cited by examiner

*Primary Examiner*—Robert Beatty
(74) *Attorney, Agent, or Firm*—Roylance, Abrams, Berdo & Goodman, L.L.P.

(57) ABSTRACT

A used toner collecting device for an image forming apparatus includes a used toner receiver for receiving used toner remaining on a surface of a photoconductive medium, a used toner conveying member for conveying the used toner received in the used toner receiver, and a used toner receptacle for storing the used toner conveyed by the used toner conveying member. The used toner conveying member includes a used toner conveying auger mounted in the used toner receiver along a lengthwise direction of the used toner receiver, a casing disposed between the used toner receiver and the used toner receptacle, and a used toner conveying belt running in the casing. The used toner conveying belt has projecting wings arranged at intervals on an outer surface of the belt. At least one of the projecting wings comprises a projecting rib.

16 Claims, 7 Drawing Sheets

USED TONER COLLECTING DEVICE AND AN IMAGE FORMING APPARATUS HAVING THE SAME

CROSS-REFERENCE TO RELATED APPLICATIONS

This application claims the benefit under 35 U.S.C. § 119 (a) of Korean Patent Application No. 2005-128133, filed Dec. 22, 2005, the entire contents of which are hereby incorporated by reference.

BACKGROUND OF THE INVENTION

1. Field of the Invention

The present invention relates to an electrophotographic image forming apparatus. More particularly, the present invention relates to a used toner collecting device capable of preventing the used toner from caking, and an image forming apparatus having the same.

2. Description of the Related Art

Generally, an image forming apparatus forms an electrostatic latent image on an image carrying medium by a laser scanning unit (LSU), develops the electrostatic latent image into a toner image by supplying toner particles, transfers the toner image onto a printing paper, and fixes the transferred image onto the printing paper with heat and pressure, thereby producing a desired image. In such an image forming apparatus, a difference in electric potentials between the image carrying medium and a transfer unit, or between the transfer unit and the printing paper, is utilized to produce the desired image. However, the toner image may not be totally transferred to the printing paper while being transferred from the image carrying medium to the transfer unit and from the transfer unit to the printing paper. In other words, toner from the toner image may partially be left on the image carrying medium or the transfer unit. The residual toner (hereinafter, referred to as 'used toner') is collected by a used toner collecting device and stored in a used toner receptacle.

FIG. 1 shows an image forming apparatus which is disclosed in Korean Patent Publication No. 2005-040973, which comprises a conventional used toner collecting device 20. Referring to FIG. 1, in such a conventional image forming apparatus 10, when a toner image is transferred sequentially from a photoconductive drum 11, onto a transfer belt 14, and then onto paper P, part of the toner remains on the photoconductive drum 11 or the transfer belt 14. The photoconductive drum 11 and the transfer belt 14 temporarily holds the toner image before the toner image is finally transferred onto the paper P. The image forming apparatus also includes a developing unit 12, a laser scanning unit 15, a transfer roller 16, an electrifying unit 17, and a fixing unit 18.

The used toner collecting device 20 comprises a used toner housing 21 for receiving the used toner T scraped off by a cleaning blade 13 that removes the used toner remaining on the photoconductive drum 11, a conveying auger 23 for moving the used toner T stacked in the used toner housing 21, a conveying duct 22 serving as a connection passage where the used toner T is moved by the conveying auger 23, and a used toner receptacle 24 storing the used toner T moved through the conveying duct 22.

The used toner T removed from the photoconductive drum 11 by the cleaning blade 13 is conveyed to the used toner receptacle 24 by the used toner collecting device 20 so that a difference in height between the cleaning blade 13 and an inlet 24*a* of the used toner receptacle 24 can be overcome. The used toner receptacle 24 is provided with the inlet 24*a* for injecting the used toner at an upper part thereof so as to efficiently receive the used toner. The conveying duct 22 includes a conveying coil (not shown) for moving the used toner T. The conveying coil comprises a flight spirally formed on an outer circumference of a rotary shaft. As the conveying coil rotates, the used toner T is conveyed to the used toner receptacle 24.

However, the conventional used toner collecting device 20 occupies a large space in the image forming apparatus 10. As laser printers are becoming smaller and less complicated, the space required by the used toner collecting device should also be reduced. In a compact laser printer, the space for discharging the used toner of the photoconductive drum and the transfer belt is especially limited.

Accordingly, the space for discharging the used toner using a conveying belt is reduced in some compact-sized image forming apparatuses. The used toner does not accumulate in the used toner collecting device comprising the conveying belt when the device normally operates. However, when the used toner collecting device does not fluently discharge the used toner from the photoconductive drum to the used toner receptacle, the used toner gradually accumulates and cakes. Moreover, the used toner may cake at the used toner outlet where the used toner drops into the used toner receptacle.

Accordingly, there is a need for a compact used toner collecting device suitable for use in a compact laser printer, and an image forming apparatus using the same.

SUMMARY OF THE INVENTION

An aspect of the present invention is to address at least the above problems and/or disadvantages and to provide at least the advantages described below. Accordingly, an aspect of the present invention is to provide a used toner collecting device capable of minimizing contamination of the inside of an image forming apparatus caused by used toner caking while being conveyed by improving the configuration of a conventional conveying belt.

Another aspect of the present invention is to provide an image forming apparatus comprising the used toner collecting device.

In accordance with an aspect of the present invention, a used toner collecting device comprises a used toner receiver for receiving used toner remaining on a surface of a photoconductive medium, a used toner conveying member for conveying the used toner received in the used toner receiver, and a used toner receptacle for storing the used toner conveyed by the used toner conveying member. The used toner conveying member comprises a used toner conveying auger mounted in the used toner receiver along a lengthwise direction of the used toner receiver, a casing disposed between the used toner receiver and the used toner receptacle, and a used toner conveying belt running in the casing and having projecting wings arranged at intervals on outer surface of the belt.

The used toner conveying member may be slanted upward from the used toner receiver to the used toner receptacle.

At least one of the projecting wings may comprise a projecting rib.

The projecting rib may extend to a lower end of an outlet of the casing. The projecting rib may be divided into a plurality of rib portions. The thickness of the projecting rib may be smaller than the thickness T of the projecting wing. The thickness of the projecting rib may be no more than 0.7 times as much as thickness T of the projecting wing. The thickness of the projecting rib may be no more than 0.3~0.5 times as much as thickness T of the projecting wing. The projecting rib may comprise a resilient member.

The used toner receptacle may comprise a used toner guide member disposed under the outlet formed at the casing.

In accordance with another aspect of the present invention, an image forming apparatus comprises an image formation unit including a photoconductive medium, and a used toner collecting device collecting used toner remaining on a surface of the photoconductive medium to a used toner receptacle. The used toner collecting device may comprise a used toner receiver for receiving used toner remaining on a surface of a photoconductive medium, and a used toner conveying member for conveying the used toner received in the used toner receiver. The used toner conveying member may comprise a used toner conveying auger mounted in the used toner receiver along a lengthwise direction of the used toner receiver, a casing disposed between the used toner receiver and the used toner receptacle, and a used toner conveying belt running in the casing and having projecting wings arranged at intervals on outer surface of the belt.

In accordance with another aspect of the present invention, a used toner collecting device comprises means for receiving used toner remaining on a surface of a photoconductive medium, means for storing used toner, and means for conveying the used toner received in the used toner receiver to the means for storing used toner. The means for conveying the used toner comprises a used toner conveying belt comprising projecting wings arranged on outer surface of the used toner conveying belt.

BRIEF DESCRIPTION OF THE DRAWING FIGURES

The above and other objects, features, and advantages of certain exemplary embodiments of the present invention will be more apparent from the following description taken in conjunction with the accompanying drawings, in which.

Throughout the drawings, the same reference numerals will be understood to refer to the same elements, features, and structures.

DETAILED DESCRIPTION OF EXEMPLARY EMBODIMENTS

The matters defined in the description such as a detailed construction and elements are provided to assist in a comprehensive understanding of the embodiments of the invention. Accordingly, those of ordinary skill in the art will recognize that various changes and modifications of the embodiments described herein can be made without departing from the scope and spirit of the invention. Also, descriptions of well-known functions and constructions are omitted for clarity and conciseness.

Figure 2:
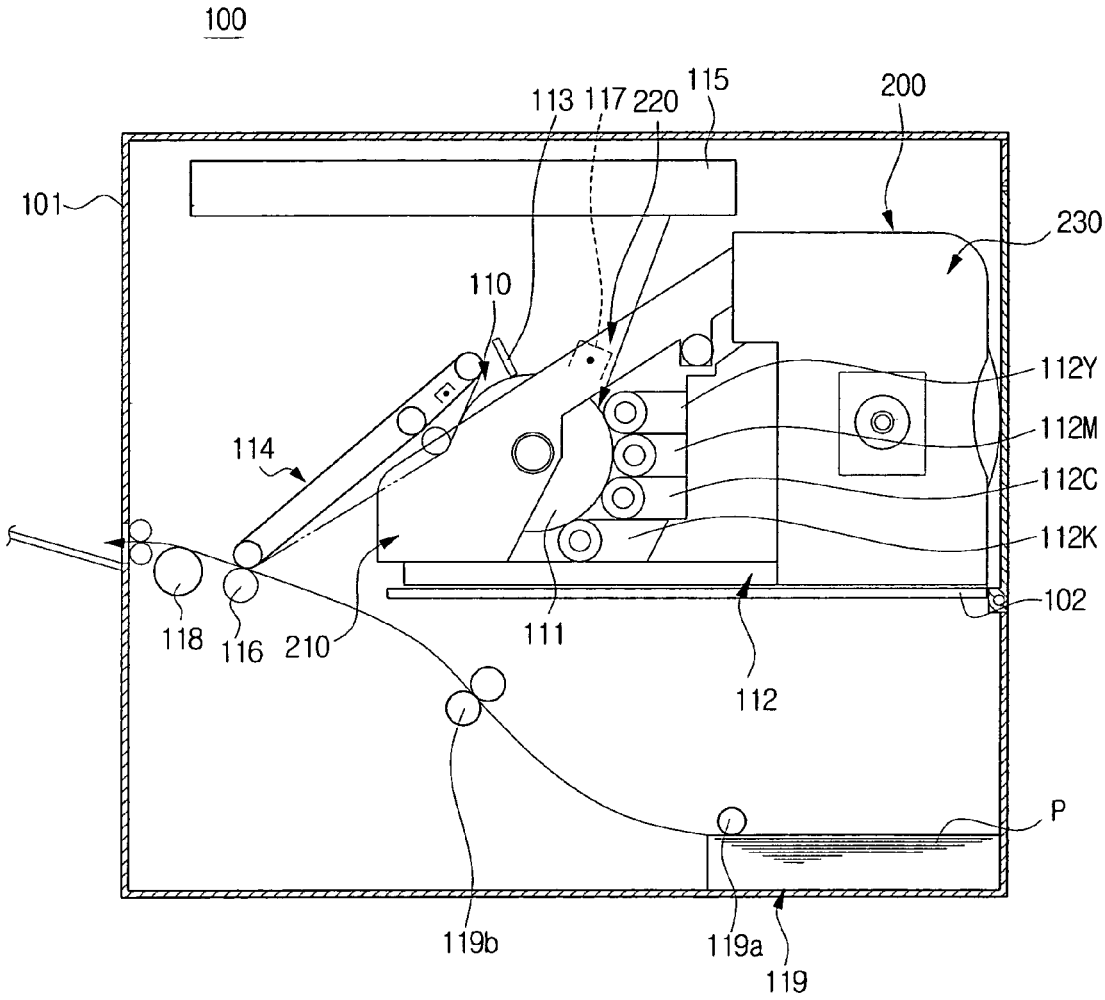
FIG. 2 is a schematic view of an image forming apparatus according to an exemplary embodiment of the present invention.

FIG. 2 shows an image forming apparatus comprising a used toner collecting device according to an exemplary embodiment of the present invention. An image forming apparatus 100 of the present exemplary embodiment comprises an image formation unit 110, and a used toner collecting device 200 for conveying and removing used toner remaining on a surface of a photoconductive medium 111.

The image formation unit 110 is removably mounted to a main frame 102 of a main body 101 of the apparatus. The image formation unit 110 comprises the photoconductive medium 111 and a developing unit 112.

Typically, the photoconductive medium 111 comprises an aluminum cylinder coated with an organic photoconductive layer. An electrifying unit 117 for charging the photoconductive medium 111, a laser scan unit 115 for projecting a light onto the photoconductive medium 111 to form an electrostatic latent image, and a developing unit 112 are arranged near the photoconductive medium 111.

The developing unit 112 comprises four developing devices 112Y, 112M 112C, and 112K for developing electrostatic latent images formed on the photoconductive medium 111 using toners of four colors, such as, yellow Y, magenta M, cyan C, and black B.

The image formation unit 110 is removably mounted in the image forming apparatus, as a single module comprising the photoconductive medium 111 and the developing unit 112. The modularized image formation unit 110 is especially suitable for a compact image forming apparatus.

A transfer unit 114 for transferring the developed images in the four colors onto a printing paper P, and a fixing unit 118 for fixing the transferred image on the paper P by heat and pressure are provided at one side of the photoconductive medium 111.

A paper feeding unit 119 is disposed at a lower part of the image formation unit 110 to feed the paper P. The paper P stacked in the paper feeding unit 119 is picked up by a pickup roller 119*a* and conveyed to a register roller 119*b*. A reference numeral 116 refers to a transfer roller. Since the above structures are generally known, a detailed description of these structures will be omitted for clarity and conciseness.

The image forming apparatus 100 further comprises a cleaning blade 113 at one side of the photoconductive medium 111 to remove the used toner. The cleaning blade 113 scrapes off the used toner remaining on the surface of the photoconductive medium 111 after the toner image is transferred from the photoconductive medium 111 to the transfer unit 114. The used toner scraped by the cleaning blade 113 is moved to a used toner receptacle 230 by the used toner collecting device 200 mounted near the photoconductive medium 111.

Figure 3:
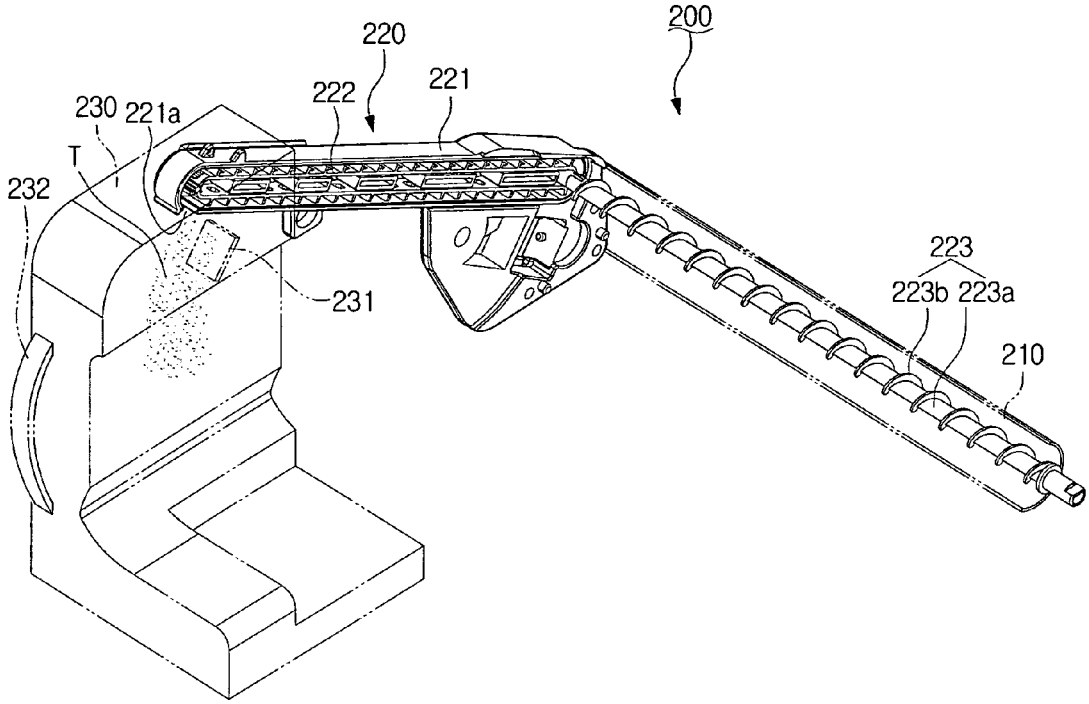
FIG. 3 is a perspective view of a used toner collecting device of the image forming apparatus of FIG. 2.
Figure 4:
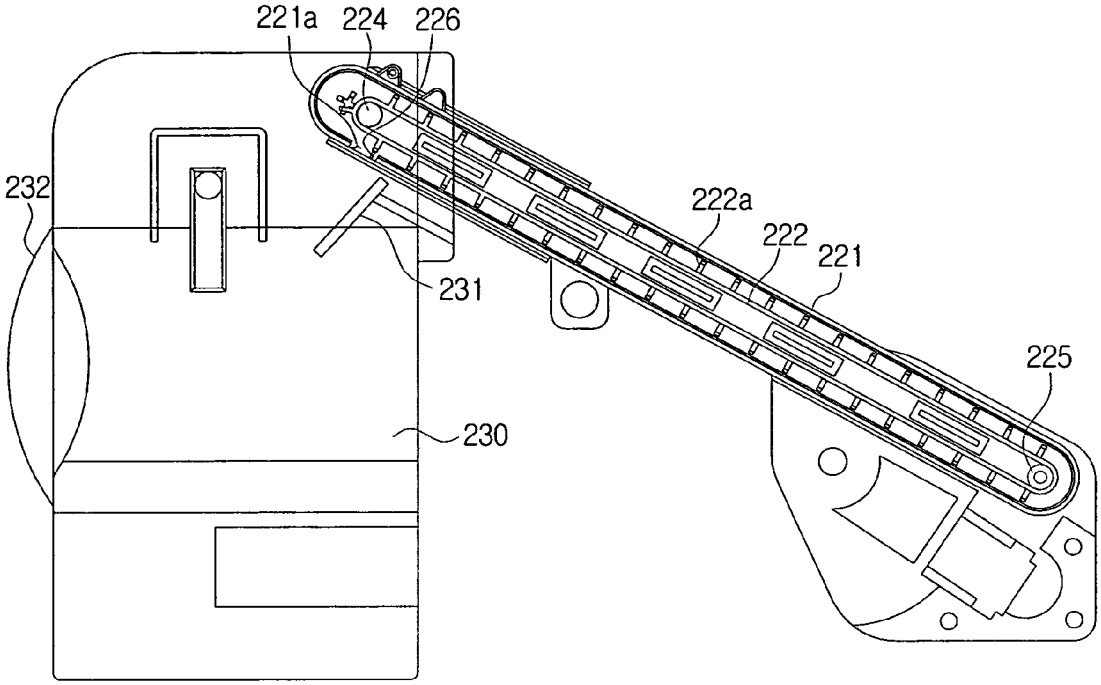
FIG. 4 is a front view of a used toner conveying member of the used toner collecting device of FIG. 3.
Figure 5:
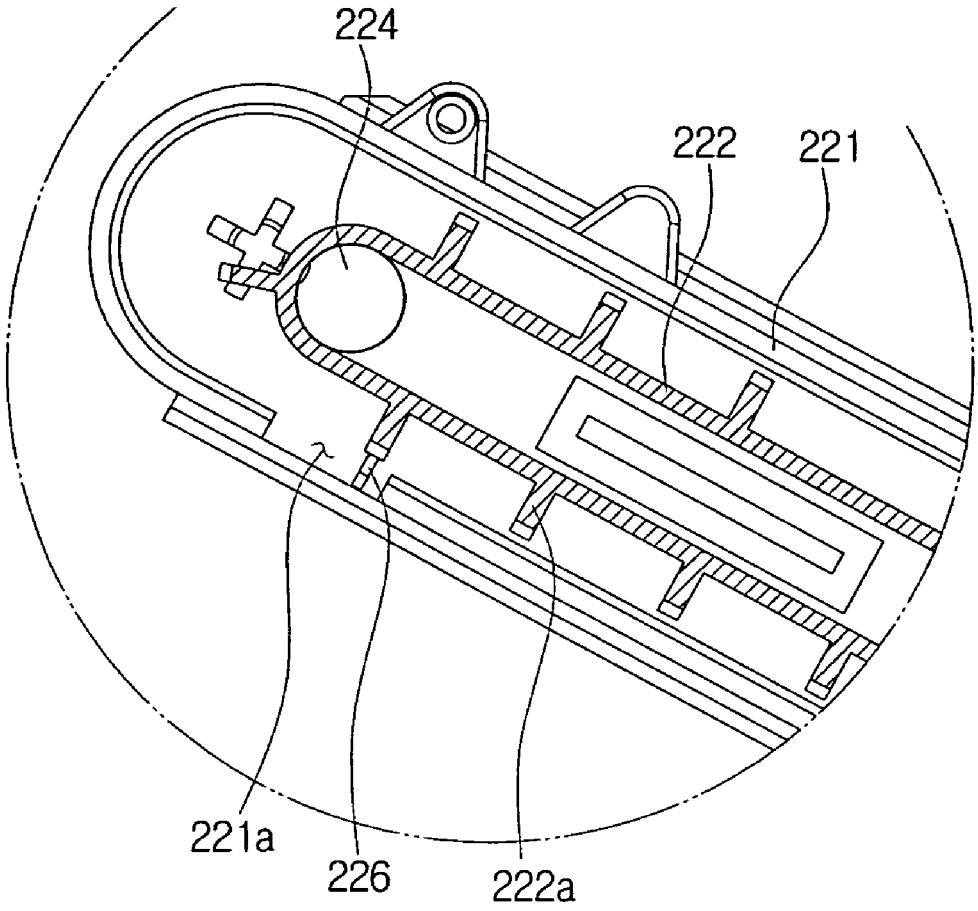
FIG. 5 is an enlarged view of a used toner outlet of a used toner conveying belt of FIG. 4.

FIG. 3 is a perspective view of the used toner collecting device 200 when removed from the image forming apparatus 100. FIG. 4 is a front view of a used toner conveying member 220 of the used toner collecting device 200. FIG. 5 is an enlarged view showing an outlet of the used toner conveying belt 222.

Referring to the drawings, the used toner collecting device 200 according to an exemplary embodiment of the present invention comprises a used toner receiver 210, the used toner conveying member 220, and the used toner receptacle 230.

The used toner receiver 210 is disposed at one side of a lower part of the photoconductive medium 111 to enclose the photoconductive medium 111 in the lengthwise direction. The used toner remaining on the surface of the photoconductive medium 111 is scraped off by the cleaning blade 113 and accumulated in the used toner receiver 210.

The used toner conveying member 220 moves the used toner received in the used toner receiver 210 to the used toner receptacle 230. The used toner conveying member 220 comprises a used toner conveying auger 223, a casing 221, and a used toner conveying belt 222.

The used toner conveying auger 223 is disposed in the used toner receiver 210 along a lengthwise direction of the used toner receiver 210. The used toner conveying auger 223 comprises an auger shaft 223*a* having a spiral flight 223*b* on an outer circumference thereof for moving the used toner to one side of the used toner receiver 210 when the auger rotates. The auger shaft 223*a* is driven by power from a driving motor of the photoconductive medium and is connected to a driving roller 225 of the used toner conveying belt 222.

The casing 221 connects one side of the used toner receiver 210 with an upper part of the used toner receptacle 230. Accordingly, the used toner conveying member 220 is sloped from the used toner receiver 210 to the used toner receptacle 230. When the used toner conveying belt 222 conveys the used toner collected to one side of the used toner receiver 201 by the used toner conveying auger 223 toward the used toner receptacle 230, the casing 221 guides the conveyance of the used toner. An outlet 221*a* for discharging the used toner to the used toner receptacle 230 is formed at a lower part of the casing 221.

The used toner conveying belt 222 interconnects the driving roller 225 and a driven roller 224 in the casing 221. The driving roller 225 is connected to the auger shaft 223*a*. The used toner conveying belt 222 comprises a plurality of projecting wings 222*a* on the outer surface thereof for moving the used toner from the used toner receiver 210 to the used toner receptacle 230.

Figure 1:
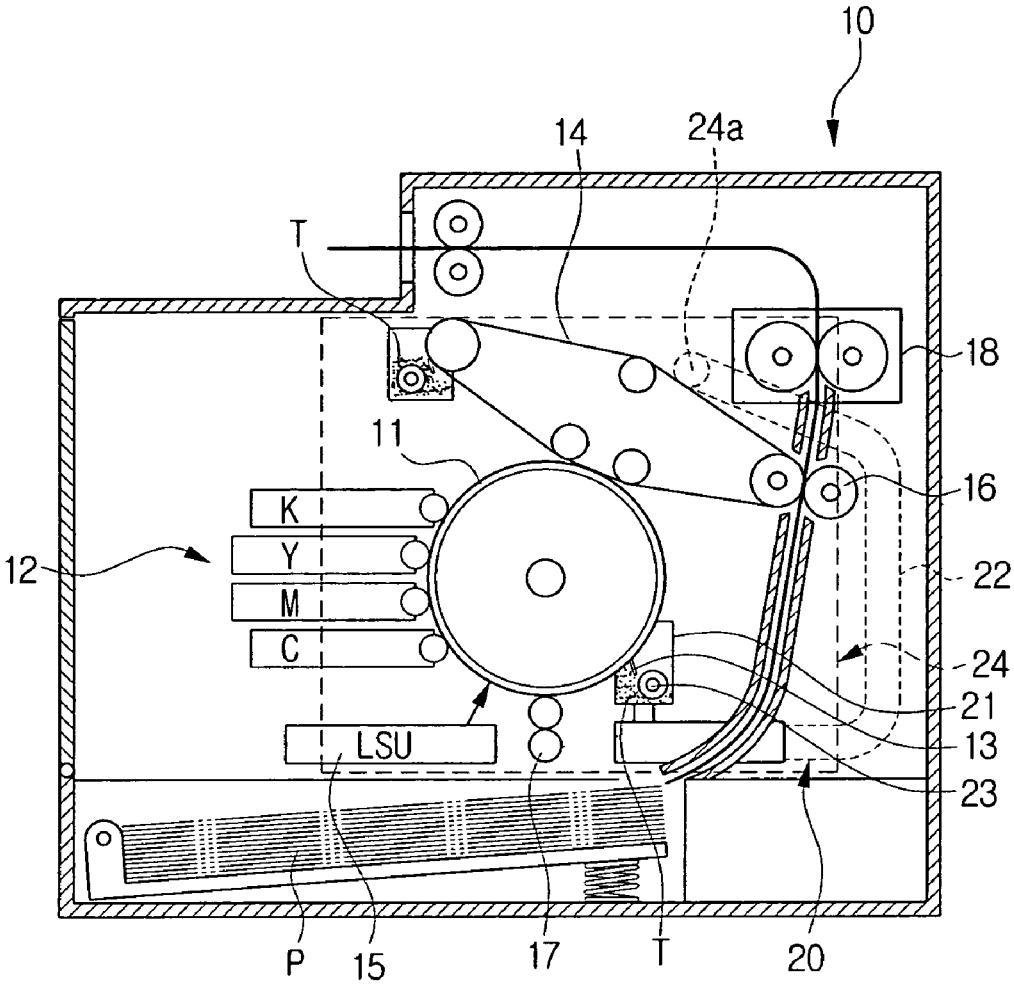
FIG. 1 (PRIOR ART)
FIG. 1 is a side view of an image forming apparatus having a conventional used toner collecting device.

The conventional used toner collecting device 20 of the general image forming apparatus 10, as shown in FIG. 1, has a structural drawback in that the used toner discharging side of the photoconductive medium 11 is disposed lower than the used toner inlet of the used toner receptacle 230. To mitigate this structural drawback, the used toner conveying belt 222 of the exemplary embodiment of the present invention comprises the plurality of projecting wings 222*a* on the outer surface of the conveying belt 222 so that the used toner is drawn by the projecting wings 222*a* from the conveying auger 223 upward to the used toner receptacle 230 and then dropped. That is, the projecting wings 222*a* draw up the used toner. The projecting wings 222*a* of the used toner conveying belt 222 are arranged at an appropriate pitch in view of the rotational speed of the used toner conveying auger 223 so that the maximum amount of the used toner discharged from the photoconductive medium 111 is greater than an amount of the used toner conveyed by the used toner conveying belt 222.

The used toner collecting device 200 according to the exemplary embodiment of the present invention may also comprise a projecting rib 226 formed at one or more of the projecting wings 222*a*. The projecting rib 226 is formed of the same resilient material, such as rubber, as the used toner conveying belt 222. As shown in FIG. 5, the projecting rib 226 may be extended up to the lower end of the outlet 221*a* of the casing 221. When at least one of the projecting wings 222*a* of the used toner conveying belt 222 has a projecting rib 226, the projecting rib 226 rubs an inner surface of the casing 221 around the outlet 221*a*, thereby preventing the used toner from caking at the outlet 221*a*. As will be described in further detail later, the projecting rib 226 resiliently bounces out at the outlet 221*a* in a running direction of the used toner conveying belt 222, thereby preventing the used toner from caking.

Figure 6:
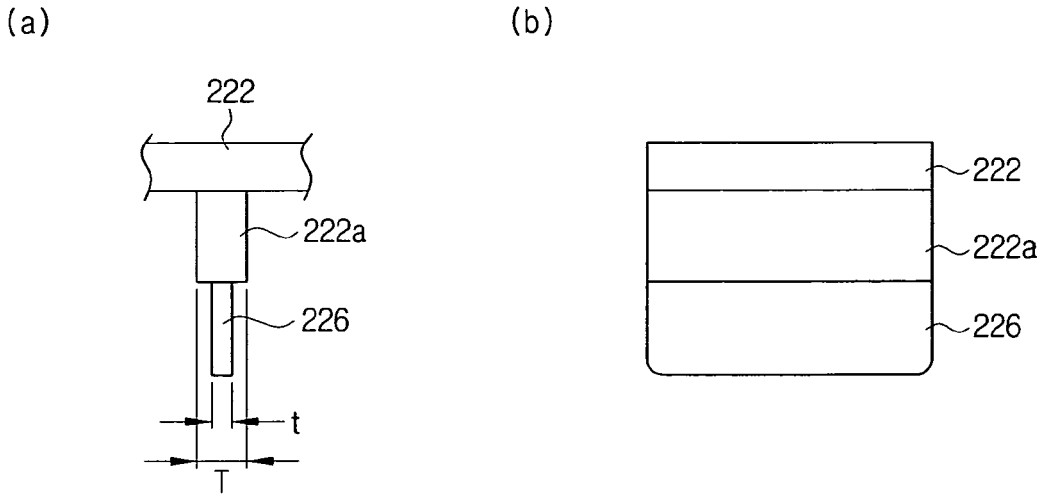
FIG. 6A is a detailed side view of a projecting rib formed on the used toner conveying belt of FIG. 5.
FIG. 6B is a detailed front view of the projecting rib of FIG. 5.
Figure 7:
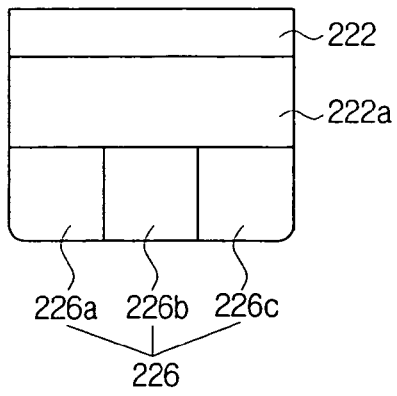
FIG. 7 is a front view of another projecting rib formed on the used toner conveying belt.

Certain exemplary embodiments of the projecting rib are shown in FIGS. 6A, 6B, and 7. FIGS. 6A and 6B, are side view and front views, respectively, that show in detail a projecting rib formed at the used toner conveying belt, according to a first exemplary embodiment of the present invention. FIG. 7 is a front view of a projecting rib according to a second exemplary embodiment of the present invention.

As shown in FIGS. 6A and 6B, the projecting rib 226 according to the first exemplary embodiment extends from an end of the projecting wing 223 and may be integrally formed with the projecting wing 223. The thickness t of the projecting rib 226 is may be no more than 0.7 times as much as the thickness T of the projecting wing 223. For example, in an exemplary embodiment, the thickness of the projecting rib 0.3~0.5 times the thickness T of the projecting wing 223. When the projecting rib 226 is too thick or thin compared to the projecting wing 223, the resilience of the projecting rib 226 may deteriorate. As a result, it becomes hard to apply vibration using the resilience of the projecting rib 226 to the used toner conveying belt 222.

The projecting rib 226 may be divided into plural rib portions 226*a*, 226*b*, and 226*c*, as shown in FIG. 7. Although three rib portions 226*a*, 226*b*, and 226*c* are illustrated in FIG. 7, the present invention is not limited to this particular number of rib portions. The projecting rib 226 comprising the rib portions 226*a*, 226*b*, and 226*c* of the second exemplary embodiment is advantageous in flexibility more than the projecting rib 226 of the first exemplary embodiment.

The used toner receptacle 230 stores the used toner T conveyed from the used toner receiver 210 by the used toner conveying belt 222. The used toner receptacle 230 is removably connected with an end of the casing 221. A guide member 231 may be provided under the outlet 221 of the casing 221 inside the used toner receptacle 230 to guide the used toner as it drops. In addition, the used toner receptacle 230 may have a handle 232 for a user to grip when separating the used toner receptacle 230 from the image formation unit 110. Therefore, when the used toner receptacle 230 is filled with the used toner T, the user may dispose of the used toner T by separating only the used toner receptacle 230 from the image formation unit 110 and replacing the filled used toner receptacle 230 with a new one.

The operation of the used toner collecting device according to the exemplary embodiments of the present invention will now be described in greater detail with reference to the accompanying drawings.

Figure 8A:
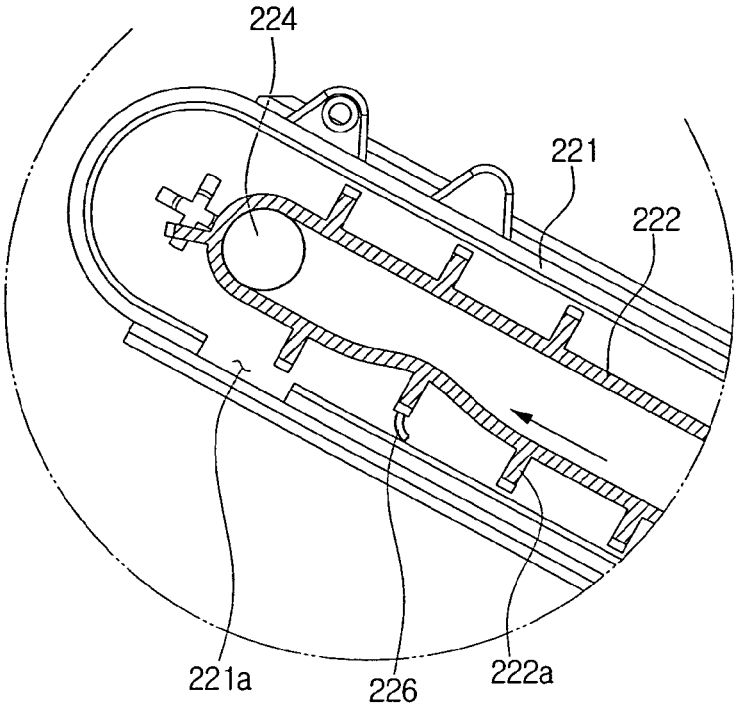
FIGS. 8A and 8B are enlarged views of the used toner conveying belt, for explaining the operational states of the used toner collecting device according to an exemplary embodiment of the present invention.
Figure 8B:
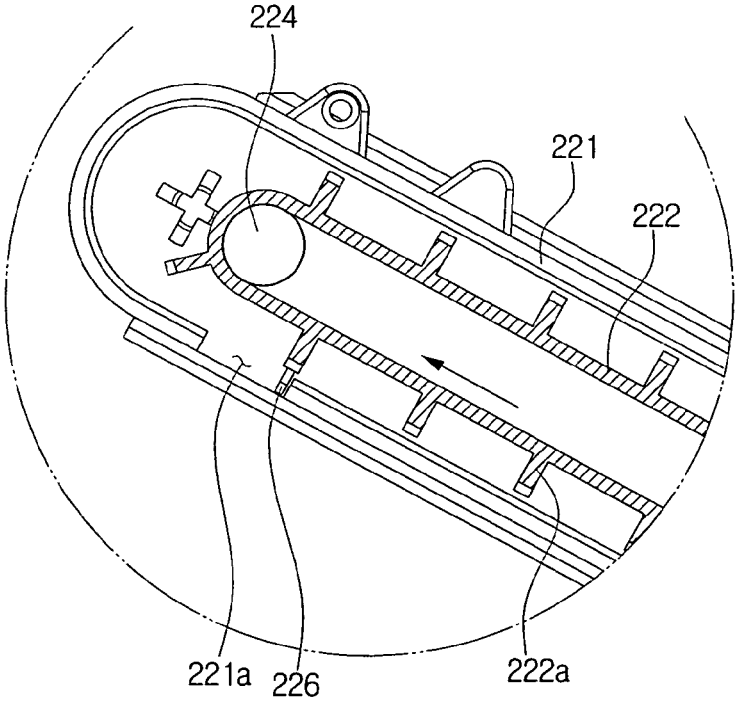

FIGS. 8A and 8B are enlarged views of the used toner conveying belt, for explaining the operation of the used toner collecting device of the present invention.

First of all, referring to FIGS. 2 and 3, in the image forming apparatus 100 according to the exemplary embodiments of the present invention, the toner image formed on the photoconductive medium 111 is transferred to the transfer unit 114, and the used toner T remaining on the surface of the photoconductive medium 111 is scraped off and accumulated in the used toner receiver 210. The used toner T accumulated on the used toner receiver 210 is pushed toward the used toner conveying belt 22 by the conveying auger 223. The used toner T moved to the lower end of the used toner conveying belt 222 is conveyed to the used toner receptacle 230 by the projecting wings 222*a* as the used toner conveying belt 222 is driven. The projecting rib 226 formed at the end of the projecting wings 222*a* assists the projecting wings 222*a* in conveying the used toner T.

Furthermore, as the conveying belt 222 moves along the inner wall of the casing 221, the projecting rib 226 lifts the portion of the used toner conveying belt 222 near the projecting rib 226*a* little, as shown in FIG. 8A. While the used toner conveying belt 222 moves in this state, when the projecting rib 226 meets the outlet 221*a*, the projecting rib 226 is inserted in the outlet 221*a*. At the same time, as soon as returning to the initial position, the used toner conveying belt 222 is resiliently bounced and generates vibration. By the vibration, the used toner T adhering to the used toner conveying belt 222 can be more effectively shaken off.

Generally, the used toner conveying auger 223 pushes the used toner T scraped off from the photoconductive medium 111 out to the used toner conveying member 220. Without the projecting rib 226, the used toner T might adhere to the inner wall of the used toner receptacle 230 around the outlet 221*a* and begin caking. As caking progresses, moreover, the used toner conveying belt 222 cannot completely sweep the used toner T away. Experimental testing shows that the used toner conveying belt 222 without the projecting rib 226 does not effectively clean the used toner T which is already caked at the outlet 221*a*. In addition, the used toner T which is not discharged but gradually accumulates inside the casing 221 starts caking, thereby finally preventing the used toner conveying belt 222 from operating normally.

In contrast, according to exemplary embodiments of the present invention, the projecting rib 226, as passing by the outlet 221*a*, enables substantially complete cleaning of the used toner T that may accumulate and cake around the lower end of the outlet 221*a*. Therefore, in the used toner collecting device 200 of the present invention, the projecting rib 226 formed at one or more of the projecting wings 222*a* scrapes the inner wall of the casing 221 around the used toner receptacle 230, accordingly preventing the used toner T from caking.

As can be appreciated from the above description of the used toner collecting device 200 according to the exemplary embodiments of the present invention, caking of the used toner T can be prevented by improving the configuration of the used toner conveying belt. Consequently, the used toner collecting device prevents contamination of the inside of the image forming apparatus by the used toner T.

While the invention has been shown and described with reference to certain exemplary embodiments thereof, it will be understood by those skilled in the art that various changes in form and details may be made therein without departing from the spirit and scope of the invention as defined by the appended claims.

What is claimed is:

1. A used toner collecting device, comprising:

a used toner receiver for receiving used toner remaining on a surface of a photoconductive medium;

a used toner conveying member for conveying the used toner received in the used toner receiver; and a used toner receptacle for storing the used toner conveyed by the used toner conveying member, wherein the used toner conveying member comprises, a used toner conveying auger mounted in the used toner receiver along a lengthwise direction of the used toner receiver, a casing disposed between the used toner receiver and the used toner receptacle, and a used toner conveying belt running in the casing, the used toner conveying belt comprising projecting wings arranged at intervals on an outer surface of the used toner conveying belt, wherein at least one of the projecting wings comprises a projecting rib.

2. The used toner collecting device of claim 1, wherein the used toner conveying member is slanted upward from the used toner receiver to the used toner receptacle.

3. The used toner collecting device of claim 1, wherein the projecting rib extends to a lower end of an outlet of the casing.

4. The used toner collecting device of claim 1, wherein the projecting rib comprises a plurality of rib portions.

5. The used toner collecting device of claim 1, wherein a thickness of the projecting rib is smaller than a thickness of the at least one projecting wing.

6. The used toner collecting device of claim 1, wherein a thickness of the projecting rib is no more than 0.7 times a thickness of the projecting wing.

7. The used toner collecting device of claim 6, wherein the thickness of the projecting rib is 0.3~0.5 times the thickness of the projecting wing.

8. The used toner collecting device of claim 1, wherein the projecting rib comprises a resilient member.

9. The used toner collecting device of claim 1, wherein the used toner receptacle comprises a used toner guide member disposed under the outlet formed at the casing.

10. An image forming apparatus, comprising:

an image formation unit comprising a photoconductive medium; and a used toner collecting device for collecting used toner remaining on a surface of the photoconductive medium to a used toner receptacle, the used toner collecting device comprising:

a used toner receiver for receiving used toner remaining on a surface of a photoconductive medium, a used toner conveying auger mounted in the used toner receiver along a lengthwise direction of the used toner receiver, a casing disposed between the used toner receiver and the used toner receptacle, and a used toner conveying belt running in the casing, the used toner conveying belt comprising projecting wings arranged at intervals on an outer surface of the used toner conveying belt, wherein at least one of the projecting wings comprises a projecting rib.

11. The image forming apparatus of claim 10, wherein the used toner receptacle is disposed higher than the photoconductive medium.

12. A used toner collecting device, comprising:

means for receiving used toner remaining on a surface of a photoconductive medium;

means for storing used toner; and means for conveying the used toner received in the used toner receiver to the means for storing used toner, comprising a used toner conveying belt comprising projecting wings arranged on outer surface of the used toner conveying belt;

wherein at least one of the projecting wines comprises a projecting rib.

13. The used toner collecting device of claim 12, wherein the conveying means further comprises:

a used toner conveying auger mounted in the used toner receiving means; and a casing disposed between the used toner receiving means and the storing means, the used toner conveying belt running in the casing.

14. The used toner collecting device of claim 12, wherein the projecting rib extends to a lower end of an outlet of the casing.

15. The used toner collecting device of claim 12, wherein the projecting rib comprises a plurality of rib portions.

16. The used toner collecting device of claim 12, wherein a thickness of the projecting rib is smaller than a thickness of the at least one projecting wing.

* * * * *